United States Patent [19]

Stallings, Jr.

[11] Patent Number: 4,902,006

[45] Date of Patent: Feb. 20, 1990

[54] ARM EXERCISE APPARATUS

[76] Inventor: Glenn E. Stallings, Jr., 5706 Fair Ave., #213, N. Hollywood, Calif. 91601

[21] Appl. No.: 196,671

[22] Filed: May 20, 1988

[51] Int. Cl.[4] ..... A63B 21/06

[52] U.S. Cl. ..... 272/118; 272/143

[58] Field of Search ..... 272/67, 117, 118, 123, 272/134, 143, DIG. 4

[56] References Cited

U.S. PATENT DOCUMENTS

| | | | |
|---|---|---|---|
| 3,428,311 | 2/1969 | Mitchell | 272/67 |
| 3,912,261 | 10/1975 | Lambert, Sr. | 272/118 |
| 4,068,843 | 1/1978 | Frost | 272/118 |
| 4,296,924 | 10/1981 | Anzaldua et al. | 272/117 |
| 4,358,108 | 11/1982 | Voris | 272/118 |
| 4,373,717 | 2/1983 | Lambert, Jr. | 272/118 X |
| 4,411,424 | 10/1983 | Barnett | 272/118 |
| 4,423,862 | 1/1984 | Hewitt | 272/67 |
| 4,431,184 | 2/1984 | Lew et al. | 272/118 X |
| 4,570,925 | 2/1986 | Kock et al. | 272/67 |
| 4,600,189 | 7/1986 | Olschansky et al. | 272/134 X |
| 4,621,807 | 11/1986 | Stramer | 272/118 X |
| 4,632,388 | 12/1986 | Schleffendorf | 272/117 X |
| 4,634,118 | 1/1987 | Jensen | 272/117 |
| 4,640,268 | 2/1987 | Roberts | 272/143 X |
| 4,648,594 | 3/1987 | Schleffendorf | 272/118 |
| 4,657,246 | 4/1987 | Salter | 272/117 |
| 4,763,897 | 8/1988 | Yakata | 272/118 |

FOREIGN PATENT DOCUMENTS

| | | | |
|---|---|---|---|
| 3205581 | 8/1983 | Fed. Rep. of Germany | 272/117 |

*Primary Examiner*—Richard J. Apley
*Assistant Examiner*—Robert W. Bahr
*Attorney, Agent, or Firm*—John J. Swartz

[57] ABSTRACT

Arm exercise apparatus comprising a frame, at least one weight, and mechanism for vertically moving the weight between a lowered position and an elevated position including a handle rotatable in either direction, a cable mechanism coupled between the handle and the weight to move the weight between a lowered rested position and an elevated position regardless of which direction the handle is rotated.

15 Claims, 2 Drawing Sheets

ARM EXERCISE APPARATUS

BACKGROUND OF THE INVENTION

1. FIELD OF THE INVENTION

This invention relates to exercise apparatus and more particularly to new and improved arm exercise apparatus.

2. DESCRIPTION OF THE PRIOR ART

Arm exercise apparatus has been provided heretofore such as that disclosed in U.S. Pat. No. 3,428,311 issued to T. J. Mitchell on Feb. 16, 1969. This prior art device does not adequately challenge certain of the arm muscles.

The inside of the forearm includes a group of flexor muscles and the outside of the foremarm includes an extensor, or brachioradialis, group of muscles. Accordingly, it is an object of the present invention to provide new and novel arm building apparatus for building arm muscles, particularly forearm muscles.

The U.S. Pat. No. 4,373,717 issued to Lloyd J. Lambert, Jr. on Feb. 15, 1983, discloses a wrist curl machine including a plurality of weights which are vertically moved by a chain and sprocket wheel assembly coupled to a rotatable hand grip. This prior art machine is limited as it will lift the weight in only one direction of handle rotation. Accordingly, it is an object of the present invention to provide arm exercise apparatus of the type described including a weight which is vertically moved in response to rotation of a handle, coupled to the weight, when the handle rotates about its axis in either direction.

Various other weight lifting apparatus has been provided heretofore which do not contemplate the instant invention such as that illustrated in the following patents: U.S. Pat. No. 4,411,424, issued to R. V. Barnett on Oct. 25, 1983; U.S. Pat. No. 4,423,862 issued to J. P. Hewitt on Jan. 3, 1984; U.S. Pat. No. 4,570,925 issued to R. W. Kock on Feb. 18, 1986, and U.S. Pat. No. 4,657,246 issued to A. Salyer on Apr. 14, 1987.

It is another object of the present invention to provide arm exercise apparatus of the type described which includes lift weights that are upwardly displaced in response to rotation of a hand grip in either direction of rotation about its axis.

Yet another object of the present invention is to provide arm exercise apparatus of the type described including a new and novel cable and sheeve assembly coupling a rotatable hand grip and a vertically moveable lift weight.

Still another object of the present invention is to provide arm exercise apparatus of the type described including a pair of cables for alternately vertically moving a lift weight when the handle is alternately rotated in opposite directions and mechanism for maintaining each of the cables taut when the other of the cables is vertically moving the lift weight.

Another object of the present invention is to provide arm exercise apparatus of the type described including an adjustable handle which allows, in one position of adjustment, the users hand to move from a pronated position to a supinated position and in a reverse position of inclination facilitates movement of the users hand from the pronated position to the supinated position.

It is an object of the present invention to provide arm exercise apparatus for exercising the flexor group of muscles when the handle is rotated in one direction and for exercising the extensor group of arm muscles when the handle is rotated in the opposite direction.

Other objects and advantages of the present invention will become apparent to those of ordinary skill in the art as the description thereof proceeds.

SUMMARY OF THE INVENTION

Arm exercise apparatus comprising: a frame; at least one lift weight; mechanism for vertically moving the lift weight on the frame between a lowered rest position and an elevated position comprising draft mechanism mounted on the frame for rotation about an axis in either direction; and a hand grip on the mechanism for rotating the draft mechanism in either direction about the axis; and coupling line mechanism connected between the draft mechanism and the lift weight for raising the lift weight between the lowered and elevated positions when the draft mechanism rotates about its axis in either direction.

BRIEF DESCRIPTION OF THE DRAWINGS

The invention may be more readily understood by referring to the accompanying drawings, in which.

DESCRIPTION OF THE PREFERRED EMBODIMENT

Figures 1, 2:
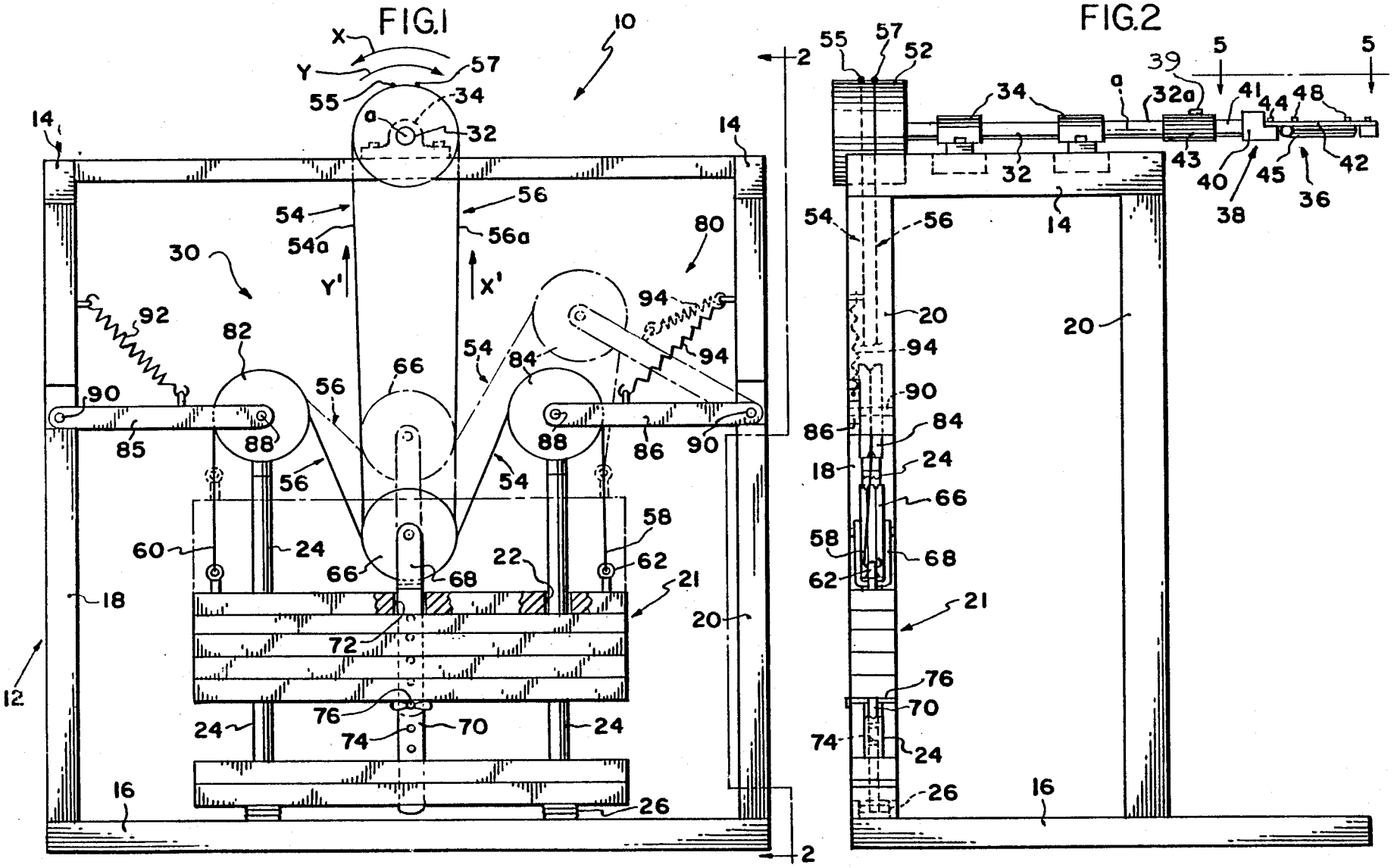
FIG. 1 is a side elevational view of apparatus constructed according to the present invention, part of the lift weight being broken away to more clearly illustrate the guide rods and a sheave mounting clevis, parts being illustrated in chain lines in an adjusted elevated position, when the handle is rotated in one direction.
FIG. 2 is an end elevational view, taken along the line 2—2 of FIG. 1.

Arm exercise apparatus, generally designated 10, constructed according to the present invention, includes a frame, generally designated 12, having top and bottom frame members 14 and 16 spanned by vertical end frame members 18 and 20. A plurality of stacked lift weights, generally designated 21, are provided and include spaced apart apertures 22, which are received on a pair of vertical guide rods 24 fixed to the bottom frame bar 16. Shock absorbers 26, mounted on each guide rod 24, are disposed between the lowermost lift weight 21 and the frame bar 16 to isolate the frame, protect the lift weights, and reduce vibration in the event the lift weights 21 are inadvertently dropped.

Apparatus, generally designated 30, is provided for vertically moving the weights 21 between the lowered position, illustrated in solid lines in FIG. 1, and the raised position illustrated in chain lines in FIG. 1. The lift apparatus 30 includes a shaft 32 mounted in bearings 34 which are fixed to the upper frame bar 14. A handle, generally designated 36, is provided for manually rotating the shaft 32. The handle 36 is detachably mounted on the shaft 32 and includes a clevis mount 38 having a base 40, which is parallel to a vertical plane perpendicular to the axis a of the shaft 32, and a pair of spaced apart legs 42 pivotally mounted on the base 40 via pins 44.

The handle base 40 includes a stub shaft 41 detachably received within a hollow sleeve 43 and detachably secured thereto via a transverse pin 39. The sleeve 43 is fixed to one end 32a of shaft 32. When the pin 39 is removed, the shaft 41 and handle 42 are axially separable to allow the user to rotationally reposition the handle 36 on the shaft 32 in any selected rotational position.

Figure 5:
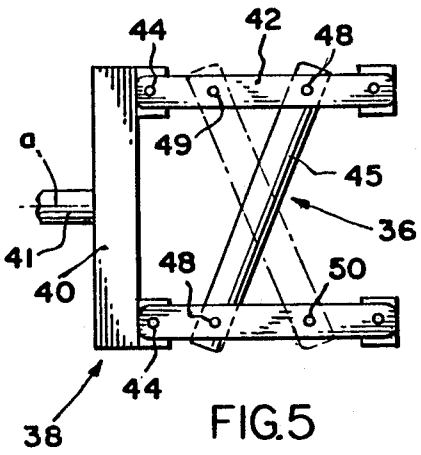
FIG. 5 is an enlarged top plan view of the handle, taken along the line 5—5 of FIG. 2.
Figure 4:
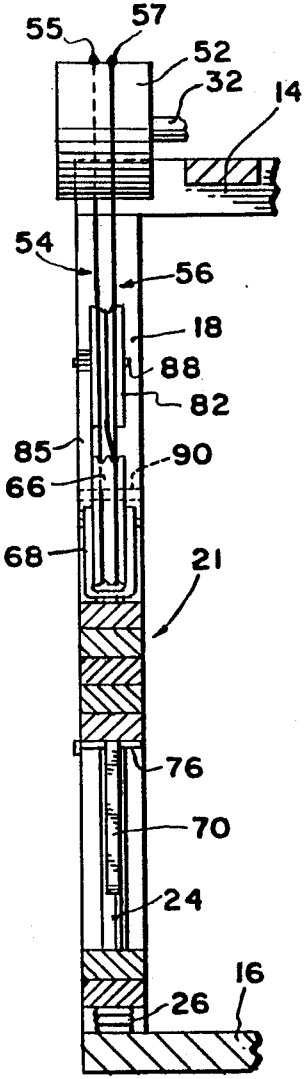
FIG. 4 is a sectional end view, taken along the line 4—4 of FIG. 1.

The shaft rotating handle 36 includes a hand grip 45 mounted on the handle legs 42 in any selected one of a plurality of different positions, such as that illustrated in solid lines and chain lines in FIG. 5, via detachable pins 48 received in vertically aligned openings 49 and 50 provided in the ends of hand grip 45 and the legs 42, respectively.

Fixed to the opposite end of the drive shaft 32 is a drive cylinder 52. A pair of weight lifting cables, generally designated 54 and 56, are coupled at ends 55 and 57, respectively, to the cylinder 52.

The opposite ends 58 and 60 of lines 54 and 56, respectively, are anchored to the uppermost weight 21 via pins 62. The weight lifting cables 54 and 56 are trained around an idler sheave or pulley 66 rotatably mounted on a clevis mount 68 fixed to the upper end of a rod 70 that is received in aligned central apertures 72 provided in the weights 21. The sheave mounting rod 70 includes a plurality of vertically spaced apertures 74 which receive a removable coupling pin 76. The operator can insert the coupling pin 76 beneath any selected one of the weights 21 such that any selected number of the weights 21 can be coupled to the rod 70.

Apparatus, generally designated 80, is provided for maintaining the cables 54 and 56 taut when not being operatively used to lift the weights 21 and includes a pair of idler sheeves or pulleys 82 and 84 rotatably mounted on pivot arms 85 and 86 respectively via pivot pins 88. The pivot arms 85 and 86 are swingably mounted on the end frame bars 18 and 20 via pivot pins 90. A pair of springs 92 and 94 are coupled between the upstanding frame end bars 18 and 20 and the pivot arms 85 and 86, respectively, for urging the pulley wheels 82 and 84 upwardly to the raised positions, illustrated in chain lines in FIG. 1, but allowing the pulley wheels 82 and 84 to move to the lowered positions illustrated in solid lines in FIG. 1.

THE OPERATION

Figure 3:
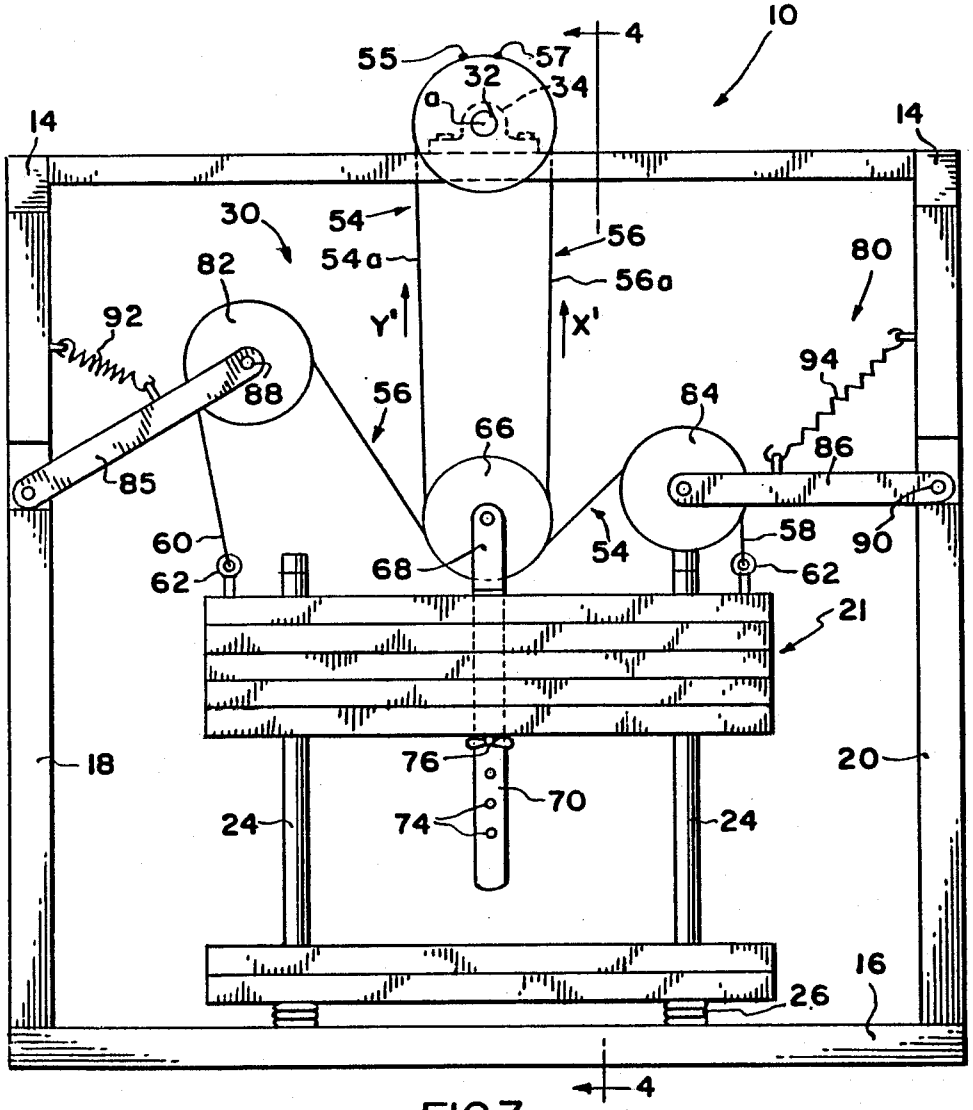
FIG. 3 is a side elevational view, similar to FIG. 1, but illustrating the parts in an adjusted elevated position when the handle is oppositely rotated.

It will be assumed that the weight coupling pin 76 is positioned in the aperture 74 of lift rod 70, as illustrated in FIGS. 1 and 3, such that only the upper five most weights 21 are coupled to the lift rod 70. It will further be assumed that the position of the hand grip 45 is in the position as illustrated in chain lines in FIG. 5.

The user will first grip the hand grip 45 with the right hand supinated and will rotate the shaft 32 and cylinder 52 about the axis a in the direction of the arrow X. When this occurs, the cable 56, which is trained around the sheeves or pulleys 66 and 82, will be maintained taut and the vertical run 56a will tend to upwardly move in the direction of the arrow X'. This will force the pulley 66, clevis 68 and lift rod 70 upwardly thus lifting the weights 21 from the rest position, illustrated in solid lines in FIG. 1 to the elevated position, illustrated in chain lines in FIG. 1.

As this occurs, the tension on cable 54 will be removed. The spring 94 will then force the idler pulley 84 upwardly from the lowered position, illustrated in solid lines in FIG. 1, to the raised position, illustrated in chain lines in FIG. 1, to maintain the cable 54 taut. The user will then rotate his right hand in the opposite direction from the pronated position to the supinated position and the parts will return to the start positions illustrated in solid lines in FIG. 1. The weights 21 will exert a muscle building force on the user's forearm as the weights are raised as well as when they are lowered.

With the hand grip remaining in the position illustrated in chain lines in FIG. 5, the user can then grasp the hand grip 45 with his left hand in the pronated position and move it in the direction of the arrow X to the supinated position, in which case the parts will again move to the positions illustrated in chain lines in FIG. 1. The user will then reversely rotate the hand grip 45 to the start position.

With the hand grip 45 in the opposite position, illustrated in solid lines in FIG. 5, the user will grasp the hand grip 45 with the left hand in the supinated position and will rotate the shaft 32 and the cylinder 52 in the opposite direction, represented by the arrow Y. This will maintain the cable 54 taut and move the cable run portion 54a upwardly in the direction of the arrow Y'. This will again force the central sheave or pulley 66 upwardly and thus, via the pin 76, move the weights 21 upwardly from the start positions, illustrated in solid lines in FIG. 1, to the elevated positions illustrated in solid lines in FIG. 3.

When this occurs, the tension will be removed from line 56 and thus the spring 92 will force the arm 85 and pulley 82 upwardly to the position illustrated in solid lines in FIG. 3 to maintain the line 56 taut. The user can then return the weights 22 to the positions illustrated in FIG. 1. With the handle remaining in the position illustrated in FIG. 5, the user can then grasp the hand grip 45 with the right hand in the pronated position and move the shaft 32 and cylinder 52 in the direction of the arrow Y such that the parts will move to the positions illustrated in FIG. 3.

It can thus be seen that by adjusting the position of hand grip bar 45, the user can exercise both the extensor and flexor muscles of either arm depending on the direction of shaft rotation.

The user can repeat the operation as many times as desired.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An arm exercise machine comprising:

a frame;

a weight stack comprised of individual weight plates mounted on said frame for vertical movement thereon;

means for moving selected ones of said weight plates between lowered positions and elevated positions comprising:

drive means rotatably mounted on said frame;

first and second idler sheaves rotatably mounted on said frame;

a third idler sheave;

means for mounting said third idler sheave on said weight stack including means for selectively detachably coupling said third idler sheave to any selected one of weight plates such that said selected one of said weight plates and all of said weight plates thereabove are concurrently moved upwardly and downwardly between said lowered positions and said elevated positions;

first line means coupled at one end to the uppermost one of said weight plates and at its opposite end to said drive means and trained around said first and third idler sheaves;

second line means having one end coupled to said uppermost weight in said stack and the opposite end thereof coupled to said drive means and trained around said second and third sheaves such that when said drive means is rotated in one direction said selected weight plates will be moved by said first line means between said lowered positions and said elevated positions and when said drive member is rotated in the opposite direction said selected weight plates will be moved by said second line means between said lowered positions and said elevated positions.

2. A forearm exercise machine comprising:

a frame;

at least one weight movably mounted on said frame;

means for vertically moving said weight between a lowered position and an elevated position comprising;

first and second rotatable idler sheaves, first and second pivot means rotatably mounting said first and second idler sheaves on said frame, said pivot means being pivotally mounted on said frame, for swinging movement between a lowered position and a raised position;

a third idler sheave rotatably mounted on said weight, a drive member rotatably mounted on said frame, handle means, coupled to said drive member for rotating said drive member in either direction;

first line means having opposite ends coupled to said weight and said drive member and trained around said third idler sheave and said first idler sheave;

second line means having opposite ends coupled to said weight and said drive member and trained around said third idler sheave and said second idler sheave such that when said drive member is rotated in one direction said weight will be moved by said first line means between said lowered position and said elevated position and when said drive member is rotated in the opposite direction said weight will be moved by said second line means between said lowered position and said elevated position.

3. The machine set forth in claim 2 including shock absorber means between said weight and said frame.

4. The machine set forth in claim 3 wherein a plurality of said weights are provided and further including means for coupling said third idler sheave to any selected number of said weights.

5. The machine set forth in claim 2 including first spring means for moving said first pivot means between said lowered position and raised position when said second line means upwardly moves said weight; and second spring means for moving said second pivot means between said lowered position and said raised position when said first line means upwardly moves said weight.

6. The machine set forth in claim 5 including guide means on said frame for guiding said weight as it moves between said lowered and elevated positions.

7. The machine set forth in claim 2 including first yieldable means reacting between said frame and said first pivot means normally urging said first sheave to said raised position when said second line upwardly moves said weight but permitting said first sheave to move to said lowered position when said first line upwardly moves said weight, second yieldable means reacting between said frame and said second pivot means normally urging said second sheave to said raised position when said first line upwardly moves said weight but permitting said second sheave to move to said lowered position when said second line upwardly moves said weight.

8. The machine set forth in claim 7 wherein said handle means comprises a hand graspable rod and means mounting said hand graspable rod in any one of a plurality of different positions of inclination relative to a plane perpendicular to the axis of rotation of said drive sheave.

9. A forearm exercise machine comprising:

a frame;

at least one weight movably mounted on said frame;

means for vertically moving said weight between a lowered position and an elevated position comprising;

first and second idler sheaves rotatably mounted on said frame;

a third idler sheave rotatably mounted on said weight, a drive member rotatably mounted on said frame, handle means, coupled to said drive member for rotating said drive member in either direction;

first line means having opposite ends coupled to said weight and said drive member and trained around said third idler sheave and said first idler sheave;

second line means having opposite ends coupled to said weight and said drive member and trained around said third idler sheave and said second idler sheave such that when said drive member is rotated in one direction said weight will be moved by said first line means between said lowered position and the elevated position and when said drive member is rotated in the opposite direction said weight will be moved by said second line means between said lowered position and said elevated position;

said handle means comprising a base coupled to said third sheave, a pair of spaced apart legs mounted on said base, a hand grip for spanning said legs remote from said base, and means for mounting said hand grip on said legs in any one of a plurality of different positions of inclination relative to said base.

10. Arm exercise apparatus comprising:

a frame;

at least one lift weight movably mounted on said frame;

means for vertically moving said weight on said frame between a lowered rest position and an elevated position comprising:

drive means mounted on said frame for rotation about a rotational axis in either direction;

hand graspable handle means on said drive means for rotating said draft means in either direction about said axis; and line means coupled between said drive means and said weight for raising said weight between said lowered position and said elevated position when said drive means moves in either direction about said axis;

said handle means including a pair of spaced apart axially extending mount bars, a hand graspable bar spanning said mount bars, and means for selectively mounting said hand graspable bar in opposite positions of inclination relative to a plane perpendicular to said rotational axis.

11. The apparatus set forth in claim 10 wherein said means for vertically moving said weight comprises:

first, second and third rotatable idler sheaves;

means swingably mounting said first and second rotatable idler sheaves on said frame;

means mounting said third rotatable idler sheave on said weight;

said line means including a first line coupled between said drive means and said weight and being trained around said first and third idler sheaves for raising said weight between said lowered and elevated positions when said drive means is rotated in one direction; and a second line coupled between said drive means and said weight and being trained around said second and third idler sheaves for raising said elevated position when said drive means is rotated in an opposite direction.

12. The apparatus set forth in claim 11 wherein said means swingably mounting said first and second idler sheaves on said frame includes a pivot arm for swingably mounting each of said first and second idler sheaves on said frame for swinging movement between raised and lowered positions, and means reacting between said frame and said pivot arms for normally urging said first and second idler sheaves to said raised positions when said second line and said first line, respectively, moves said weight between said lowered and elevated positions but allowing said first and second idler sheaves to move to lowered positions when said first line and said second line, respectively, moves said weight between said lowered and elevated positions.

13. The apparatus set forth in claim 12 wherein said handle means comprises a clevis mounting having a pair of spaced apart axially extending legs, a hand grip bar spanning said legs, and means selectively mounting said hand grip bar in any one of a plurality of different positions of inclination relative to said axis.

14. Arm exercise apparatus comprising a frame;

drive means mounted on said frame for rotation in either direction about a rotational axis;

adjustable resistance means connected to said drive means and adapted to resist rotation thereof; and hand graspable handle means on said drive means for rotating said drive means in either direction about said axis including a base member;

a hand graspable bar extending generally transverse of said axis; and means for selectively mounting said hand graspable bar in any selected one of a plurality of opposite positions of inclination relative to a plane perpendicular to said rotational axis so that said handle means can be grasped by either hand.

15. The apparatus set forth in claim 14 wherein said hand graspable handle means includes adjustable grip means movable to a position which facilitates movement of the users hand gripping said grip means from a pronated position to a supinated position and an oppositely inclined position which facilitates movement of the users hand gripping said grip means from a pronated position to a supinated position.

* * * * *